US011834242B1

(12) United States Patent
McHatet

(10) Patent No.: US 11,834,242 B1
(45) Date of Patent: Dec. 5, 2023

(54) ELECTRONICS CABLE RETAIL PACKAGING

(71) Applicant: Hamid McHatet, Miami, FL (US)

(72) Inventor: Hamid McHatet, Miami, FL (US)

( * ) Notice: Subject to any disclaimer, the term of this patent is extended or adjusted under 35 U.S.C. 154(b) by 0 days.

(21) Appl. No.: 17/931,758

(22) Filed: Sep. 13, 2022

(51) Int. Cl.
*B65D 85/04* (2006.01)
*B65D 73/00* (2006.01)

(52) U.S. Cl.
CPC ..... *B65D 73/005* (2013.01); *B65D 85/04* (2013.01)

(58) Field of Classification Search
CPC ..... B65D 85/04; B65D 73/0007; B65D 73/0014; B65D 73/0042; B65D 73/005; B65D 73/0021; B65D 85/67
USPC ..... 206/702, 489, 495
See application file for complete search history.

(56) References Cited

U.S. PATENT DOCUMENTS 1,367,600 A * 2/1921 Hirsch ..... B65D 5/504 206/553
2,394,457 A * 2/1946 Lobl ..... B65D 73/0021 206/380
3,002,722 A * 10/1961 Cote ..... B65D 71/007 206/499
3,272,326 A * 9/1966 Kutlow ..... B65D 85/04 242/610.2
3,530,980 A * 9/1970 Link ..... B65D 85/04 206/394
3,540,583 A * 11/1970 Tomlinson ..... B65D 73/005 206/466
4,133,427 A * 1/1979 Loomis ..... F42B 39/007 206/820
4,134,493 A * 1/1979 Cech ..... B65D 5/504 206/326
4,300,683 A * 11/1981 Roccaforte ..... B65D 73/0085 248/152
5,131,542 A * 7/1992 Stenstrom ..... B65D 71/10 206/476
5,375,717 A * 12/1994 Roshdy ..... B65D 81/056 206/464
5,392,919 A * 2/1995 Passamoni ..... B65D 73/0085 206/576
5,477,964 A * 12/1995 Hart ..... B65D 73/0021 206/483
5,704,479 A * 1/1998 Barnett ..... B65H 49/322 206/416
10,179,691 B2 * 1/2019 McCarren ..... B65H 55/00
11,459,205 B2 * 10/2022 Roussel ..... B65H 49/322
2005/0035240 A1 * 2/2005 Weck ..... B65H 49/322 242/588.4

* cited by examiner

*Primary Examiner* — Steven A. Reynolds
(74) *Attorney, Agent, or Firm* — ALBERT BORDAS, P.A.

(57) ABSTRACT

An electronics cable retail packaging, having a base assembly, which has a first end section having a first elongated hole and a second end section having a second elongated hole. The base assembly and the first and second end sections are a single piece to secure a cable. The base assembly is rectangular in shape. The first end section bends toward the base upper face defining a predetermined angle with respect to the base assembly, and the second end section bends toward the base upper face defining a predetermined angle with respect to the base assembly. The first and second elongated holes are oval in shape. The cable is positioned longitudinally onto the base upper face. The first elongated hole receives a first section of the cable, and the second elongated hole receives a second section of the cable.

8 Claims, 3 Drawing Sheets

ELECTRONICS CABLE RETAIL PACKAGING

BACKGROUND OF THE INVENTION

Field of the Invention

The present invention relates to packaging, and more particularly, to electronics cable retail packaging.

Description of the Related Art

Applicant is not aware of any electronics cable retail packaging having the novel features of the present invention.

SUMMARY OF THE INVENTION

The present invention is an electronics cable retail packaging, comprising a base assembly comprising a first end section having a first elongated hole, and a second end section having a second elongated hole, wherein the base assembly and the first and second end sections are a single piece to secure a cable.

The base assembly comprises a base upper face, a base lower face, and first and second base lateral edges. The base assembly is rectangular in shape. The first and second end sections comprise first and second upper faces, first and second lower faces, and first and second external ends respectively. The first and second end sections each comprises respective first and second lateral edges. The first end section bends toward the base upper face defining a predetermined angle with respect to the base assembly. The predetermined angle is between about 100 and 175 degrees. The second end section bends toward the base upper face defining a predetermined angle with respect to the base assembly. The predetermined angle is between about 100 and 175 degrees.

The first and second elongated holes are oval in shape. The first and second elongated holes extend transversally on the first and second end sections respectively. The first elongated hole comprises elongated edges substantially parallel to the first external end, and the second elongated hole comprises elongated edges substantially parallel to the second external end.

The cable is positioned longitudinally onto the base upper face. The first elongated hole receives a first section of the cable, and the second elongated hole receives a second section of the cable. The cable passes through the first and second elongated holes, whereby the first and second sections of the cable enter from the first and second upper faces respectively and exit through the first and second lower faces respectively.

The base assembly further comprises at least one adhesive strip. The at least one adhesive strip is transversally positioned on the base assembly to secure the cable. The first elongated hole comprises a first predetermined area and the second elongated hole comprises a second predetermined area. The first predetermined area and the second predetermined area are approximately the same.

It is therefore one of the main objects of the present invention to provide an electronic cable retail packaging.

It is another object of this invention to provide an electronic cable retail packaging, which has holes to secure a cable.

It is another object of this invention to provide an electronic cable retail packaging that is volumetrically efficient for carrying, transporting, and storage.

It is another object of this invention to provide an electronic cable retail packaging, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
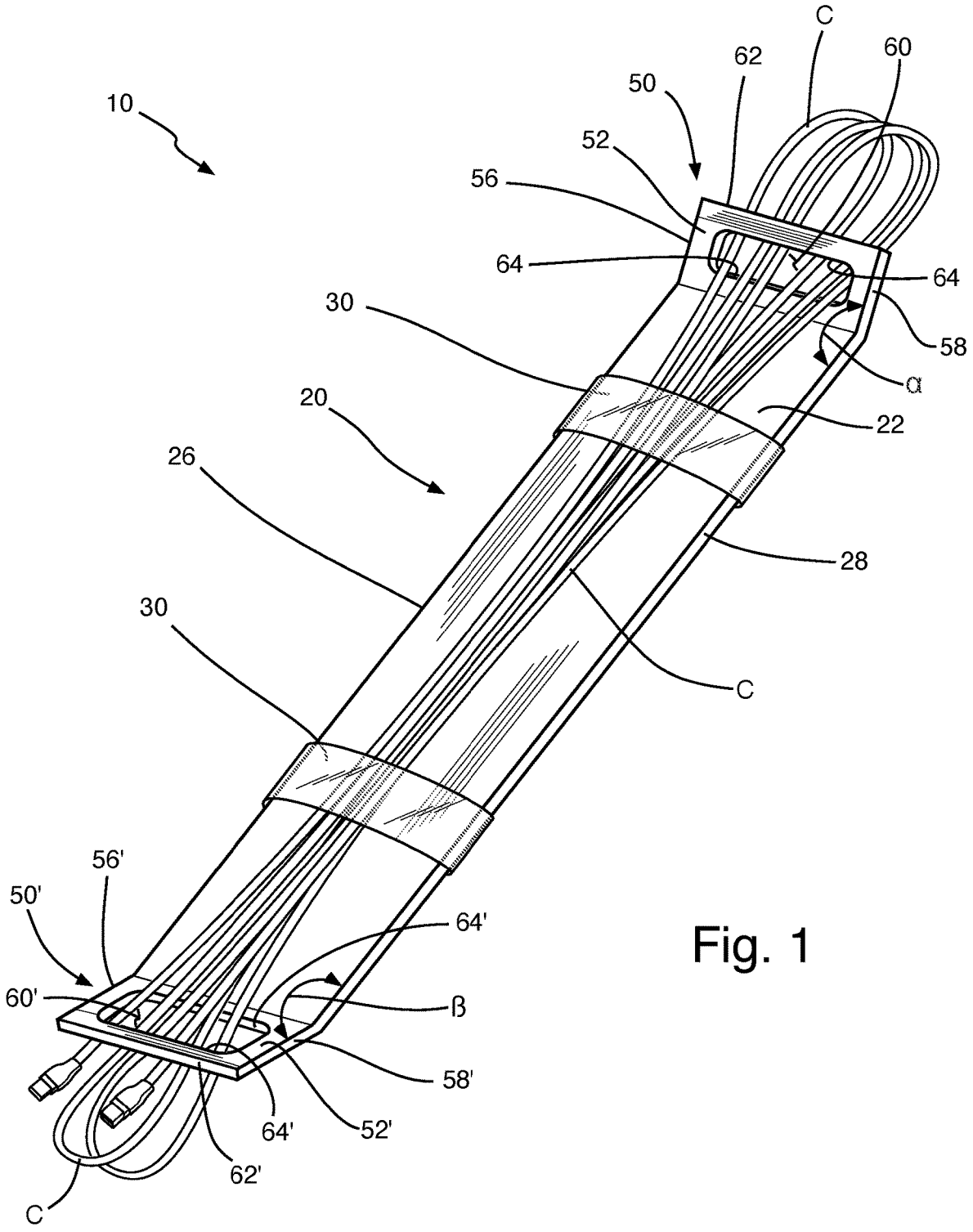
FIG. 1 is a top isometric view of the present invention securing a sample electronics cable.

Referring now to the drawings, the present invention is an electronics cable retail packaging, and is generally referred to with numeral 10. It can be observed that it basically includes base assembly 20, first end section 50, and second end section 50'.

Figure 2:
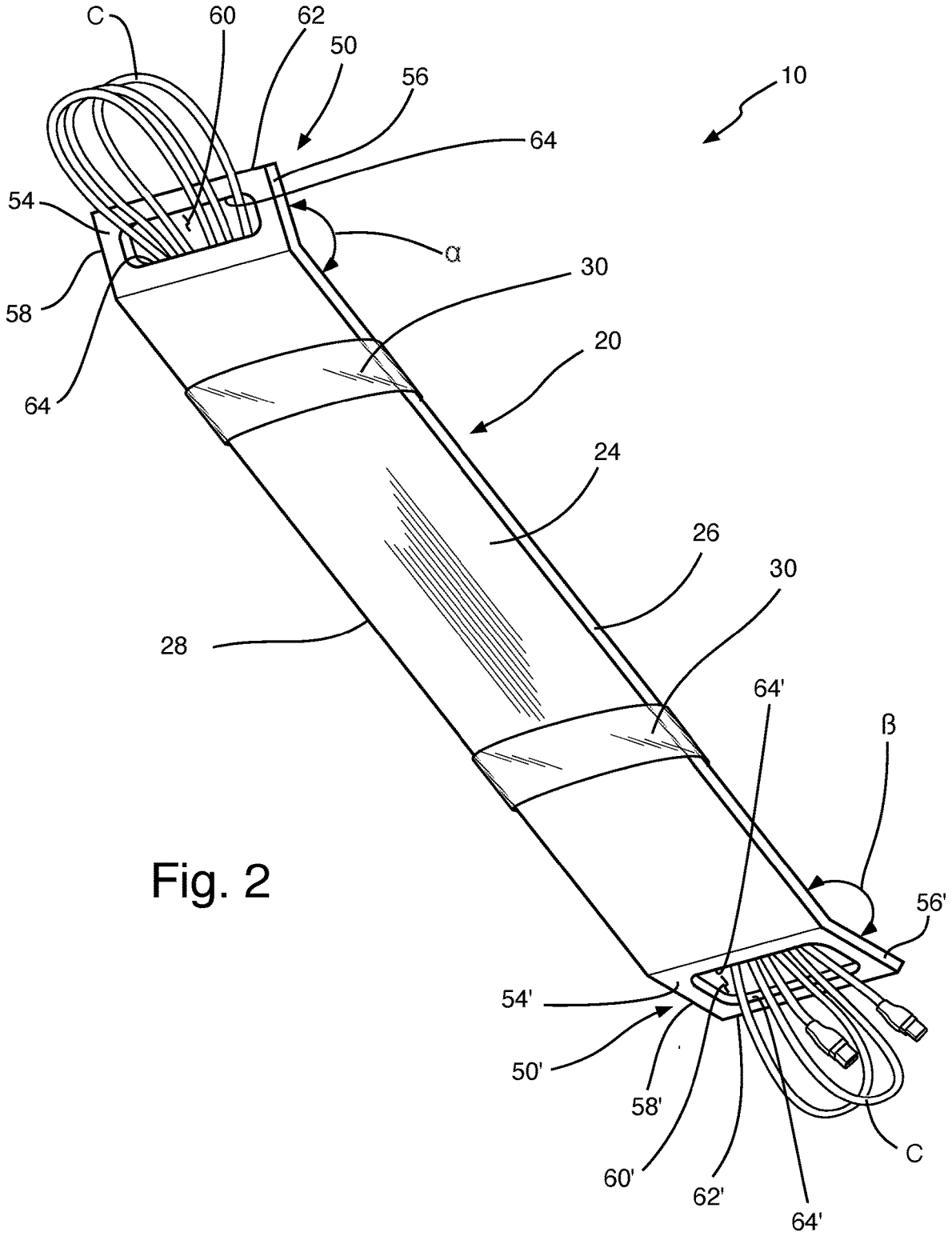
FIG. 2 is a rear isometric view of the present invention securing the sample electronics cable.

As seen in FIGS. 1 and 2, base assembly 20 comprises base upper face 22, base lower face 24, and first and second base lateral edges 26 and 28. First and second end sections 50 and 50' comprise first and second upper faces 52 and 52', first and second lower faces 54 and 54', and first and second external ends 62 and 62' respectively. End section 50 comprises lateral edges 56 and 58. End section 50' comprises lateral edges 56' and 58'. First end section 50 comprises first elongated hole 60, and second end section 50' comprises second elongated hole 60'.

Base assembly 20 and first and second end sections 50 and 50' are a single piece to secure cable C. In a preferred embodiment, the single piece is made of cardboard, plastic, or other material having similar characteristics to secure cable C thereon. In a preferred embodiment, cable C is an electrical or electronics cable for computers, machines, and/or electrical devices. Cable C is positioned longitudinally onto base upper face 22. First elongated hole 60 receives a first section of cable C, and second elongated hole 60' receives a second section of cable C. Cable C passes through elongated holes 60 and 60' entering through upper faces 52 and 52' and exiting through lower faces 54 and 54'. Base assembly 20 further comprises at least one adhesive strip 30. The at least one adhesive strip 30 is transversally positioned on base assembly 20 to secure cable C. In a preferred embodiment, present invention 10 comprises first and second adhesive strips 30 to secure cable C at both ends. In a preferred embodiment, base assembly 20 is rectangular in shape. Present invention 10 is manufactured in a plurality of sizes, varying mainly in length, to be used for cables C of any size.

Figure 3:
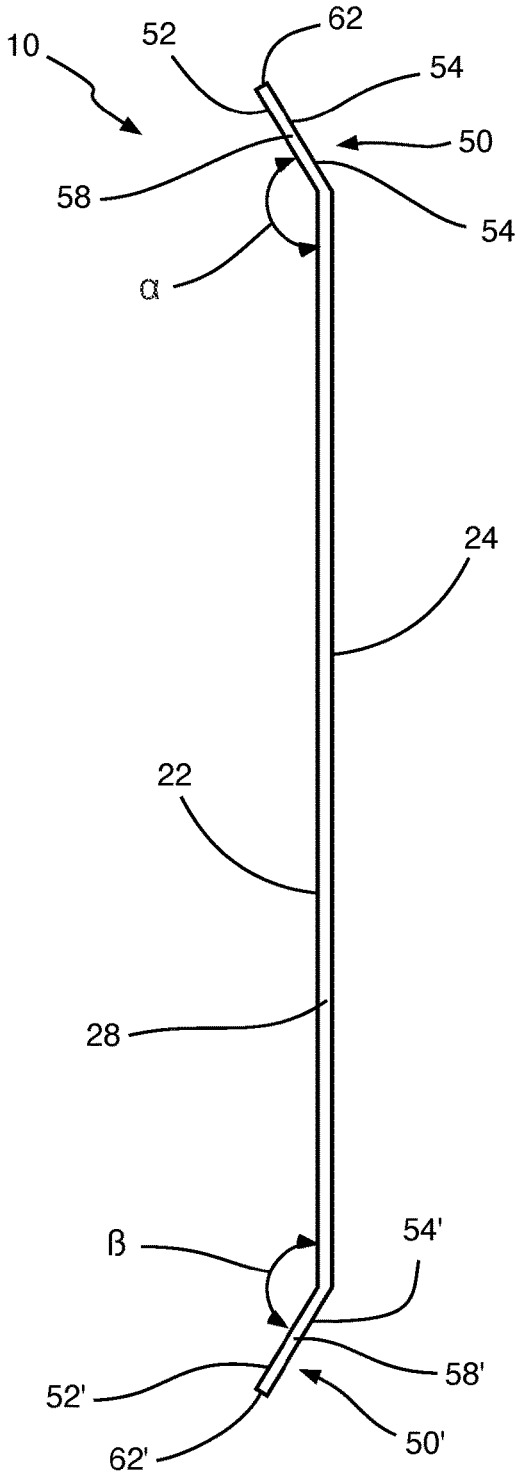
FIG. 3 is a side view of the present invention.

As seen in FIGS. 2 and 3, first and second end sections 50 and 50' bend toward base upper face 22 to define an appropriate angle, whereby respective elongated holes 60 and 60' receive cable C. In a preferred embodiment, first end section 50 bends toward base upper face 22 defining a predetermined angle $\alpha$ with respect to base assembly 20. The predetermined angle $\alpha$ is between about 100 and 175 degrees. In the same way, second end section 50' bends toward base upper face 22 defining a predetermined angle with respect to base assembly 20. The predetermined angle $\beta$ is between about 100 and 175 degrees.

Figure 4:
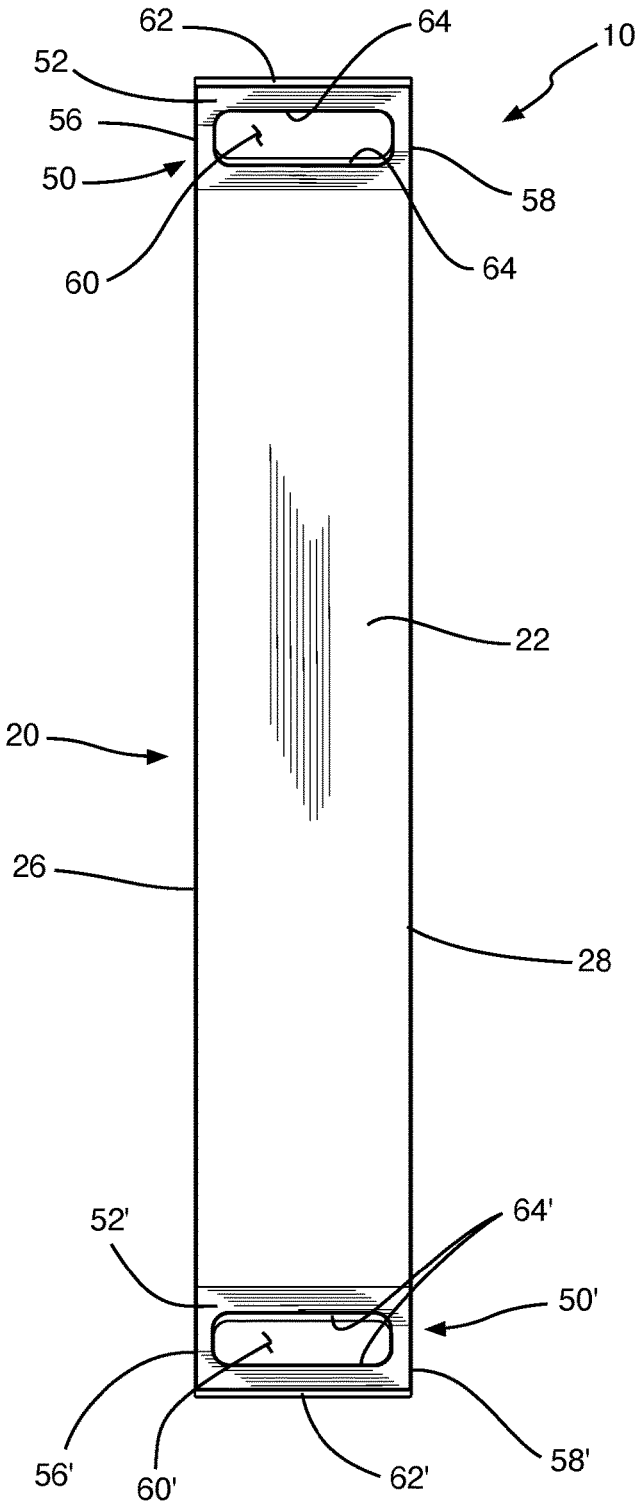
FIG. 4 is a front elevational view of the present invention.

As seen in FIG. 4, first and second elongated holes 60 and 60' are oval in shape. Elongated holes 60 and 60' extend transversally on first and second end sections 50 and 50', respectively. Elongated hole 60 comprises elongated edges 64 substantially parallel to external end 62, and elongated hole 60' comprises elongated edges 64' substantially parallel to external end 62'. Elongated hole 60 defines a first predetermined area, and elongated hole 60' defines a second predetermined area. The first predetermined area and the second predetermined area are approximately the same.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An electronics cable retail packaging, comprising a base assembly comprising a first end section having a first elongated hole and a second end section having a second elongated hole; wherein said first elongated hole receives a first section of a cable and said second elongated hole receives a second section of said cable; wherein said base assembly, and said first and second end sections are a single piece to secure said cable; said base assembly comprises a base upper face, a base lower face, and first and second base lateral edges; said first and second end sections bend toward said base upper face defining a predetermined angle between about 100 and 175 degrees respectively with respect to said base assembly; said first and second elongated holes are oval in shape; said first and second end sections comprise first and second upper faces, first and second lower faces, and first and second external ends respectively; wherein said first and second external ends are free ends; said first elongated hole comprises elongated edges substantially parallel to said first external end and said second elongated hole comprises elongated edges substantially parallel to said second external end; and said base assembly further comprises at least one adhesive strip, which is transversally positioned on said base assembly to secure said cable.

2. The electronics cable retail packaging set forth in claim 1, wherein said base assembly is rectangular in shape.

3. The electronics cable retail packaging set forth in claim 1, wherein said first and second end sections each comprise respective lateral edges.

4. The electronics cable retail packaging set forth in claim 1, wherein said first and second elongated holes extend transversally on said first and second end sections respectively.

5. The electronics cable retail packaging set forth in claim 1, wherein said cable is positioned longitudinally onto said base upper face.

6. The electronics cable retail packaging set forth in claim 1, wherein said cable passes through said first and second elongated holes, whereby said first and second sections of said cable enter from said first and second upper faces respectively and exit through said first and second lower faces respectively.

7. The electronics cable retail packaging set forth in claim 1, wherein said first elongated hole comprises a first predetermined area and said second elongated hole comprises a second predetermined area.

8. The electronics cable retail packaging set forth in claim 7, wherein said first predetermined area and said second predetermined area are approximately the same.

* * * * *